US012180661B1

(12) United States Patent
Li et al.

(10) Patent No.: US 12,180,661 B1
(45) Date of Patent: Dec. 31, 2024

(54) METHOD FOR RAPID DEMOLISHING OF CEMENT CONCRETE PAVEMENT SLAB AND DEVICE THEREOF

(71) Applicant: RESEARCH INSTITUTE OF HIGHWAY MINISTRY OF TRANSPORT, Beijing (CN)

(72) Inventors: Sili Li, Beijing (CN); Bo Tian, Beijing (CN); Jinde Xie, Beijing (CN); Lei Quan, Beijing (CN); Lihui Li, Beijing (CN); Panpan Zhang, Beijing (CN); Zhe He, Beijing (CN)

(73) Assignee: RESEARCH INSTITUTE OF HIGHWAY MINISTRY OF TRANSPORT, Beijing (CN)

( * ) Notice: Subject to any disclaimer, the term of this patent is extended or adjusted under 35 U.S.C. 154(b) by 0 days.

(21) Appl. No.: 18/806,720

(22) Filed: Aug. 16, 2024

Related U.S. Application Data

(63) Continuation of application No. PCT/CN2024/095567, filed on May 27, 2024.

(30) Foreign Application Priority Data

Jan. 16, 2024 (CN) ..... 202410057896.0

(51) Int. Cl.
*E01C 23/09* (2006.01)

(52) U.S. Cl.
CPC ..... *E01C 23/0926* (2013.01)

(58) Field of Classification Search
CPC ... E01C 23/09; E01C 23/0926; E01C 23/0933
See application file for complete search history.

(56) References Cited

U.S. PATENT DOCUMENTS

| | | | | |
|---|---|---|---|---|
| 3,904,245 A * | 9/1975 | Clarke | B28D 1/265 | 125/7 |
| 5,176,426 A * | 1/1993 | Adamson | B28D 1/045 | 404/90 |
| 7,473,052 B2 * | 1/2009 | Hall | E01C 23/14 | 404/83 |
| 7,591,607 B2 * | 9/2009 | Hall | E01C 19/40 | 404/93 |

FOREIGN PATENT DOCUMENTS

| | | | |
|---|---|---|---|
| CN | 106087686 A | * | 11/2016 |
| CN | 113047144 A | | 6/2021 |
| CN | 216919941 U | | 7/2022 |
| CN | 217997767 U | | 12/2022 |
| CN | 117822405 B | * | 5/2024 |

* cited by examiner

*Primary Examiner* — Gary S Hartmann

(57) ABSTRACT

A method for rapid demolishing of a cement concrete pavement slab and a device there for. The device includes a demolishing vehicle, and the demolishing vehicle includes a base disposed at a bottom of the demolishing vehicle. The first shallow cutting allows first saws to make a minimal cut into the cement concrete pavement, increasing the cutting speed. A second deeper cutting is made on the basis of the grooves cut by the first saws, and although second saws have a larger feed, a cutting thickness of the cement concrete pavement is reduced by the first saws. A third cutting follows the same principle as the previous cuttings.

7 Claims, 5 Drawing Sheets

METHOD FOR RAPID DEMOLISHING OF CEMENT CONCRETE PAVEMENT SLAB AND DEVICE THEREOF

CROSS-REFERENCE TO RELATED APPLICATION

This application claims priority to Chinese patent application No. CN 202410057896.0, filed to China National Intellectual Property Administration (CNIPA) on Jan. 6, 2024, which is herein incorporated by reference in its entirety.

TECHNICAL FIELD

The disclosure relates to the technical field of road demolishing, and particularly to a method for rapid demolishing of a cement concrete pavement slab and a device thereof.

BACKGROUND

The current airport and port terminal pavements are paved with cement concrete because they can withstand heavy loads, such as airplanes and container trucks, and their load-bearing capacity is far superior to that of asphalt pavements. When cement concrete pavements are damaged and need to be repaired, the common approach is to use a sledgehammer to demolish the pavement, remove the debris completely, and then pour in new cement, which takes more than twenty days to reach the required strength to meet the needs of navigation and traffic. The maintenance is difficult and the cycle is long. Therefore, how to quickly replace the damaged pavement slabs with new ones to achieve quick navigation and traffic is the fundamental technical problem to be solved.

In the related art, the conventional technical scheme is to demolish by hammering the pavement, which is inefficient and requires more manpower and resources to collect the broken pieces after the hammering. This further extends repair time for the damaged pavement and increases the subsequent repair time for the damaged pavement, thus reducing the efficiency of pavement repair.

SUMMARY

In order to compensate for the shortcomings in related art and solve the above-mentioned technical problems, a method for rapid demolishing of a cement concrete pavement slab and a device thereof are provided.

The technical solutions of the disclosure are as follows.

Specifically, a device of rapid demolishing of a cement concrete pavement slab includes a demolishing vehicle, and the demolishing vehicle includes a base, first boxes, second boxes, third boxes, driving crossbeams and driving longitudinal beams.

The base is disposed at a bottom of the demolishing vehicle, a pavement range finder is disposed at a bottom of the base, a shape of the base is square, and positioning transceivers are slidably installed at four corners of the bottom of the base, respectively.

The first boxes defined with first openings at bottoms thereof are slidably installed at the bottom of the base, each of the first boxes is disposed with a first telescoping rod, a working end of the first telescoping rod is provided with a first saw, and a top of each of the first boxes is provided with a first moving component.

The second boxes defined with second openings at bottoms thereof are slidably installed on the bottom of the base, each of the second boxes is disposed with a second telescoping rod, a working end of the second telescoping rod is provided with a second saw, and a top of each of the second boxes is provided with a second moving component.

The third boxes defined with third openings at bottoms thereof are slidably installed on the bottom of the base, each of the third boxes is disposed with a third telescoping rod, a working end of the third telescoping rod is provided with a third saw, and a top of each of the third boxes is provided with a third moving component. The first box, the second box, and the third box are arranged in a straight line in that order, and the first box, the second box, and the third box are as a respective one of four groups disposed at the bottom of the base, and movement paths of the four groups of the first boxes, the second boxes, and the third boxes form a rectangular pavement demolishing area.

The driving crossbeams are disposed on the bottom of the base, and driving longitudinal beams are disposed between the driving crossbeams and the base. The first boxes, the second boxes, and the third boxes are all disposed at bottoms of the driving crossbeams and the driving longitudinal beams, and a number of the driving crossbeams and a number of the driving longitudinal beams are two. A cooling component is disposed at the bottom of the base, the cooling component is configured to cool the first saw, the second saw, and the third saw.

In an embodiment, the first saw and the second saw are circular saws, a size of the first saw is smaller than that of the second saw, and the third saw is a chain saw.

In an embodiment, the first saw and the second saw include multiple saw blades, and the multiple saw blades in the first saw and the second saw are uniformly disposed side by side; and cutting widths of the first saw, the second saw, and the third saw are the same.

In an embodiment, widths between sides facing away from each other of adjacent first saws, between sides facing away from each other of adjacent second saws, and between sides facing away from each other of adjacent third saws are the same as a width of the rectangular pavement demolishing area. More specifically, widths between sides facing away from each other of adjacent first saws on the driving crossbeams, between sides facing away from each other of adjacent second saws on the driving crossbeams, and between sides facing away from each other of adjacent third saws on the driving crossbeams are the same as a width of the rectangular pavement demolishing area. Length between sides facing away from each other of adjacent first saws on the longitudinal beams, between sides facing away from each other of adjacent second saws on the longitudinal beams, and between sides facing away from each other of adjacent third saws on the longitudinal beams are the same as a length of the rectangular pavement demolishing area.

In an embodiment, in each one of the four groups, the second box is provided with a telescopic rod on a side facing away from the first box, and a working end of the telescopic rod is provided with a first plate. first blocks are symmetrically slidingly connected to a bottom of the first plate, a limit plate is disposed at tops of the first blocks, and the limit plate penetrates through the first plate and is located at a top of the first plate. The top of the first plate is slidably connected to a limit rod, and a spring is provided between the limit rod and the first plate. A side of the first plate facing the limit rod is a serrated part, and a middle part of the limit rod is engaged with the serrated part of the first plate. A reset board is disposed at a side of the second box, and the reset board is inclinedly disposed above the limit plate.

In an embodiment, a cross-section of each of the first blocks is a triangle, and sides of the first blocks close to each other are vertical planes. A side of the second box close to the telescopic rod is slidably and inclinedly connected to a guide plate, and a spring is disposed between the first plate and the guide plate. A collection box is disposed on another side of the second box, and a top opening of the collection box is close to an end of the guide plate.

In an embodiment, the sides of the first blocks close to each other are serrated parts, and the serrated parts in the first blocks are inclined towards the first plate.

In an embodiment, the first saw, the second saw, and the third saw are provided with a dust cover.

In an embodiment, sweeping brushes are arranged around the demolishing vehicle in a sliding connection manner, and the demolishing vehicle is provided with limited position pins disposed below the sweeping brushes.

A method for rapid demolishing of the cement concrete pavement slab is provided as follows.

S1: before constructing, using a controlling module to control a driving module in the demolishing vehicle to complete a movement of the demolishing vehicle, until the demolishing vehicle moving to the rectangular pavement demolishing area, then using the controlling module to control the driving crossbeams and the driving longitudinal beams to move the first boxes, the second boxes, and the third boxes to planned rectangular edges of the rectangular pavement demolishing area;

S2: performing a first cutting, driving the first saw to make contact with a pavement by the first telescoping rod, followed by driving each of the first boxes and the first saw to cut the pavement in a straight line direction through the first moving component. After cutting a specified length of the pavement by the first saw, followed by performing a second cutting on the pavement along a cutting trajectory of the first saw by the second saw; and S3: finally, performing a third cutting on the pavement along a cutting trajectory of the second saw by the third saw, thereby completing a cutting of a cement concrete layer on the pavement. Lifting and replacing the cement concrete pavement slab after the cutting by changed equipment through construction personnel, and thereby completing the demolishing of the cement concrete pavement slab.

It should be noted that, the controlling module and the driving module are provided with a memory and a processor, executable codes are stored in the memory, and the processor is configured to execute the executable codes to implement the method for rapid demolishing of the cement concrete pavement slab provided in the disclosure.

The beneficial effects of the disclosure are as follows.

1. The disclosure provides a method for rapid demolishing of a cement concrete pavement slab and a device thereof. By sequentially cutting the pavement with the first saws, the second saws, and the third saws, the disclosure, as compared to the related art that uses a single saw blade to cut the pavement in one go, employs a method of cutting multiple times from shallow to deep. This disclosure can effectively avoid the safety hazards associated with the operation of a single saw blade, thereby enhancing the safety of construction.

2. The disclosure provides the method for rapid demolishing of the cement concrete pavement slab and the device thereof. During the road cutting process, the first shallow cutting allows the first saws to make a minimal cut into the cement layer, which increases the cutting speed. The second deeper cutting is made on the basis of the groove cut by the first saws, and although the second saws have a larger feed, the cutting thickness of the cement layer is reduced by the first saws, resulting in a reduced cutting volume for the second saws while also increasing the cutting speed. The third cutting follows the same principle as the previous cuttings, allowing for multiple cuttings while still improving the cutting speed. This increases the efficiency of road demolishing construction, accelerates the replacement of pavement slabs, and thus improves the efficiency of road repair, achieving the effect of quick navigation and traffic.

BRIEF DESCRIPTION OF DRAWINGS

Further explanation of the disclosure will be provided below in conjunction with the attached drawings.

DESCRIPTION OF REFERENCE NUMERALS

Figure 1:
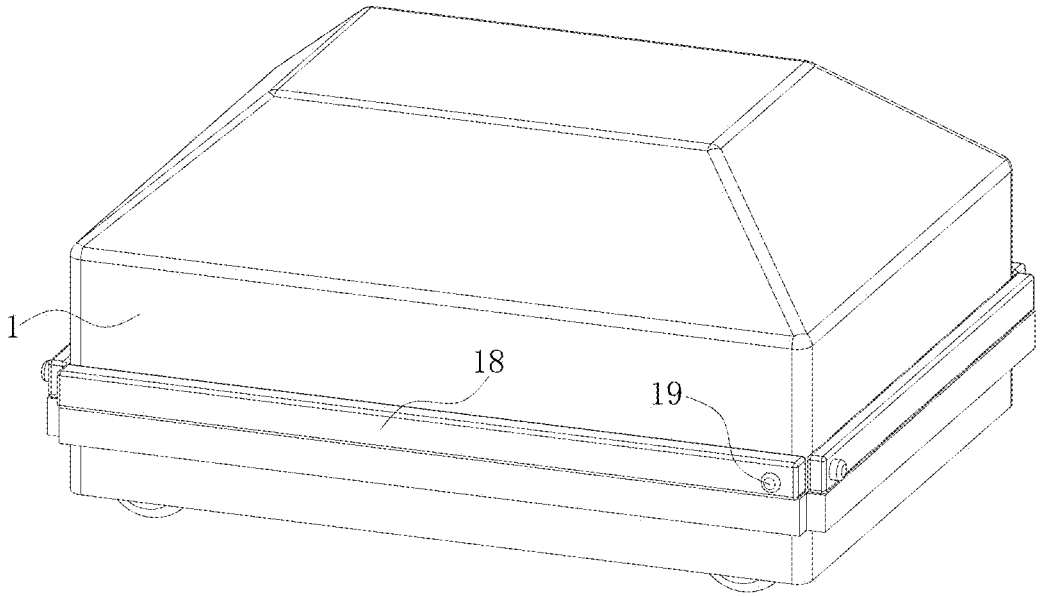
FIG. 1 illustrates a three-dimensional view of a device of rapid demolishing of a cement concrete pavement slab in the disclosure.
Figure 2:
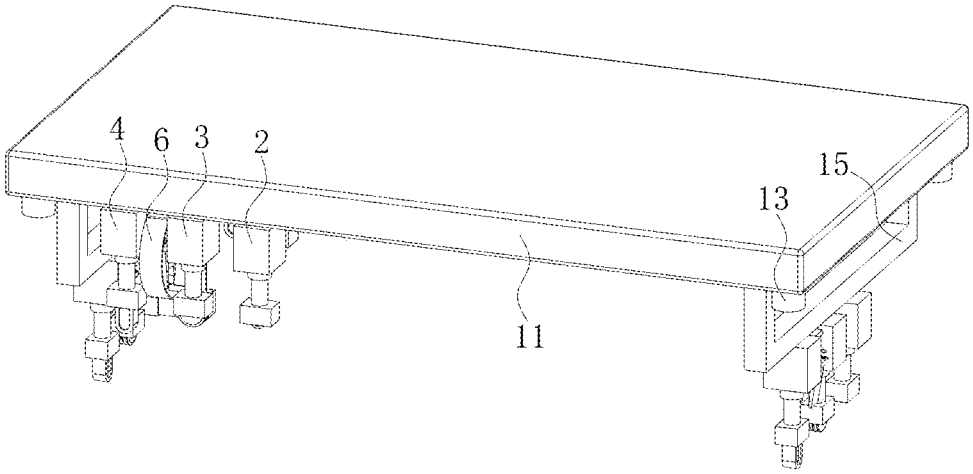
FIG. 2 illustrates a three-dimensional view of a base of the device in the disclosure.
Figure 3:
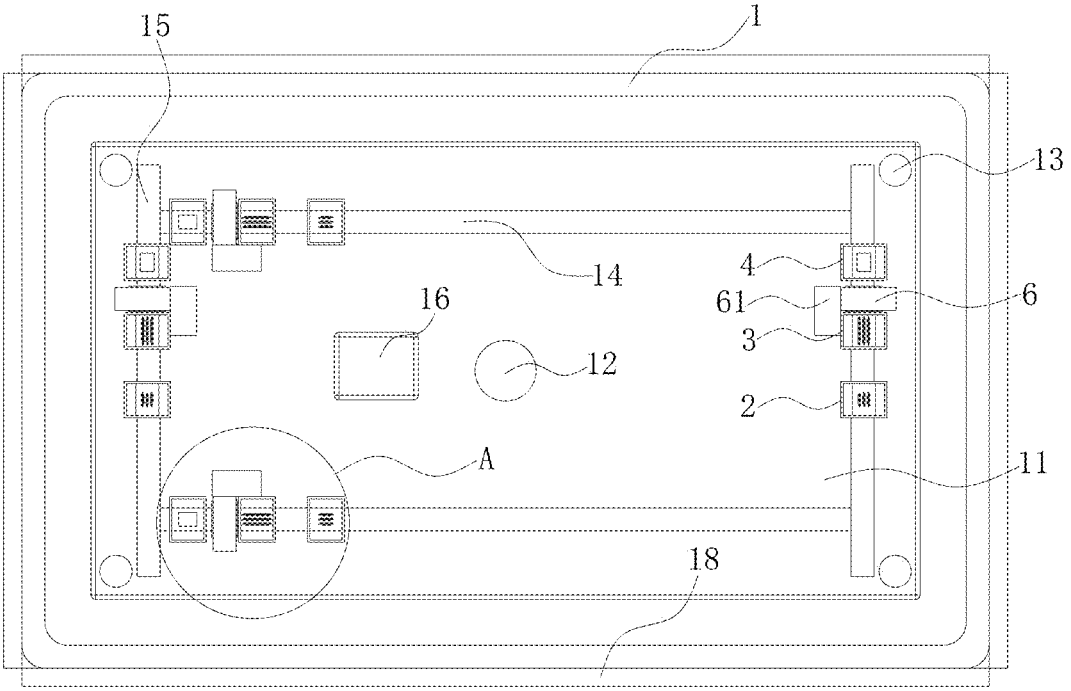
FIG. 3 illustrates a top view of the device of rapid demolishing of the cement concrete pavement slab in the disclosure.
Figure 4:
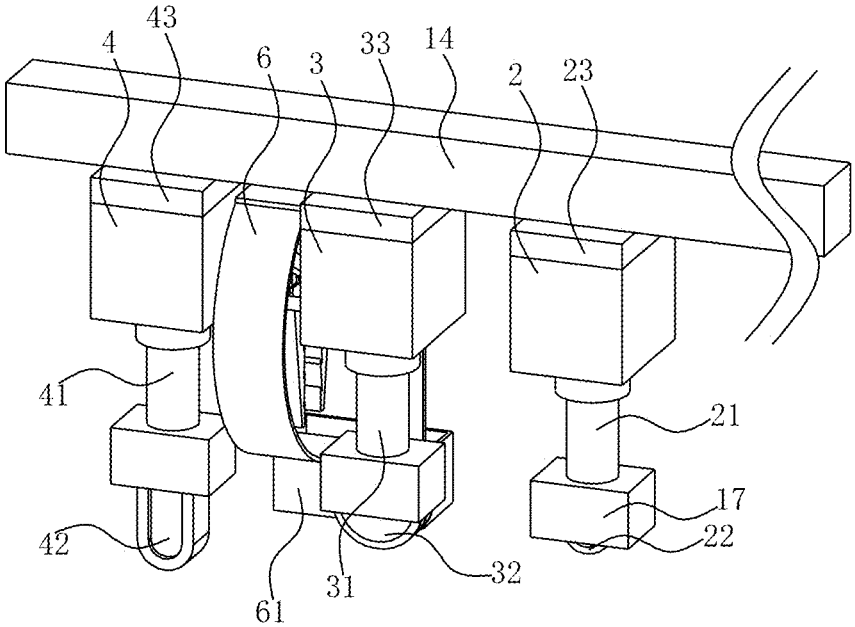
FIG. 4 illustrates a three-dimensional view of a driving crossbeam of the device in the disclosure.
Figure 5:
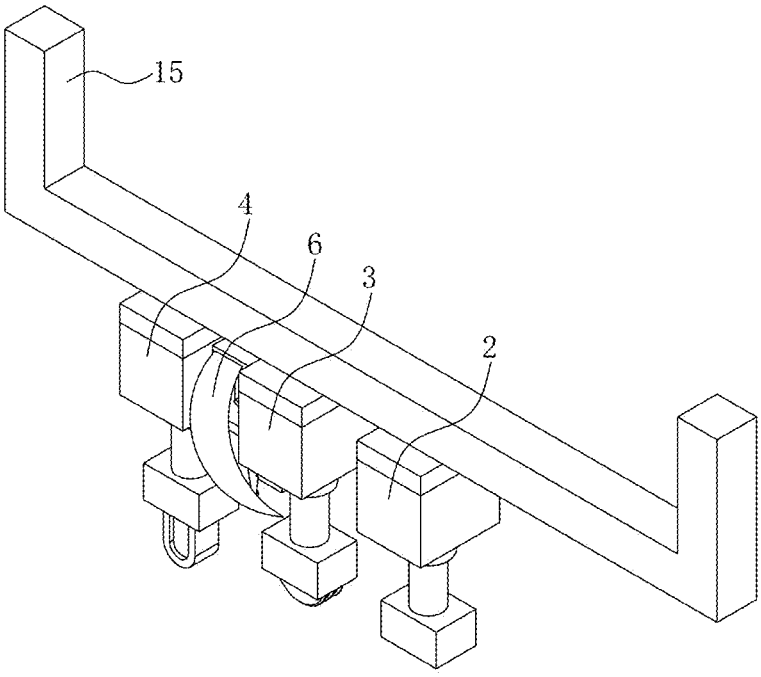
FIG. 5 illustrates a three-dimensional view of a driving longitudinal beam of the device in the disclosure.
Figure 6:
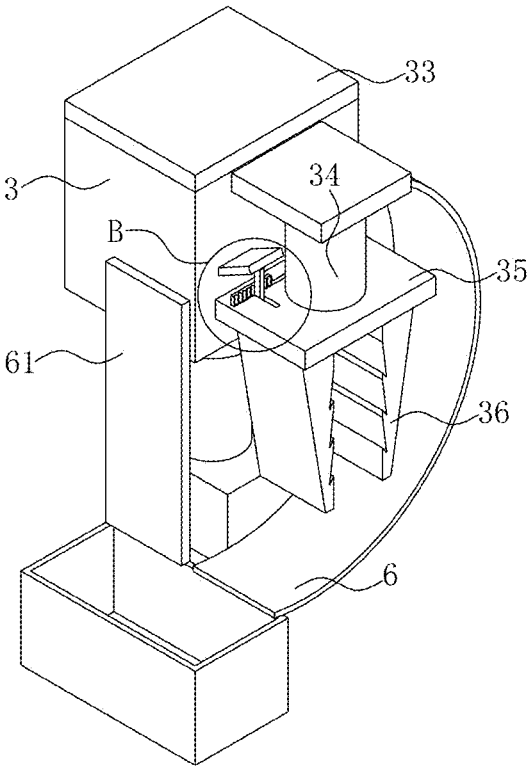
FIG. 6 illustrates a three-dimensional view of first blocks of the device in the disclosure.
Figure 7:
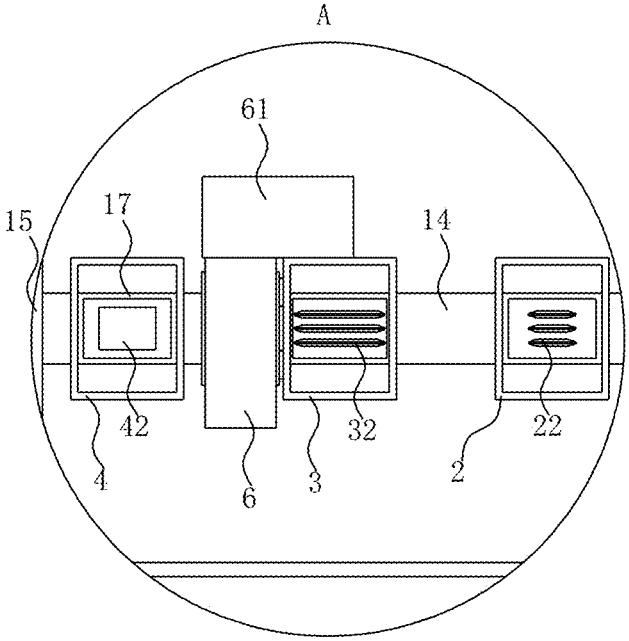
FIG. 7 illustrates an enlarged structural view of a portion A illustrated in FIG. 3 in the disclosure.
Figure 8:
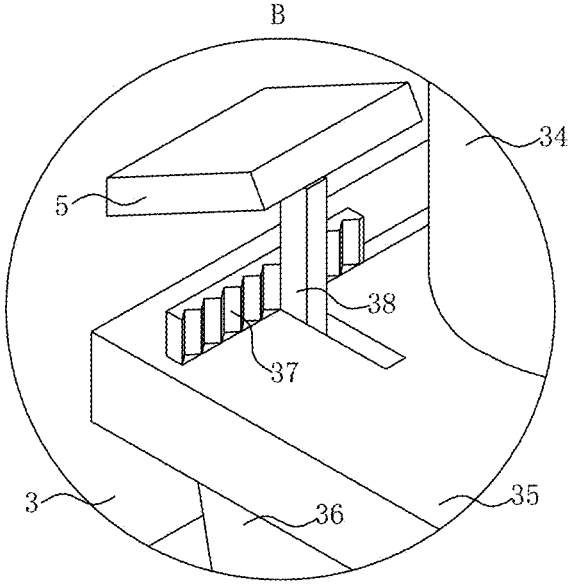
FIG. 8 illustrates an enlarged structural view of a portion B illustrated in FIG. 6 in the disclosure.

1. demolishing vehicle; 11. base; 12. pavement range finder; 13. positioning transceiver; 14. driving crossbeam; 15. driving longitudinal beams; 16. cooling component; 17. dust cover; 18. sweeping brush; 19. position pin; 2. first box; 21. first telescoping rod; 22. first saw; 23. first moving component; 3. second box; 31. second telescoping rod; 32. second saw; 33. second moving component; 34. telescopic rod; 35. first plate; 36. first block; 37. limit plate; 38. limit rod; 4. third box; 41. third telescoping rod; 42. third saw; 43. third moving component; 5. reset board; 6. guide plate; 61. collection box.

DETAILED DESCRIPTION OF EMBODIMENTS

The following will provide a clear and complete description of the technical solution in the embodiments of the disclosure, as shown in the attached drawings. Apparently, the described embodiments are only a part of the embodiments of the disclosure, not all of them. Based on the embodiments in the disclosure, all other embodiments obtained by those skilled in the art without creative labor fall within the scope of protection of the disclosure.

Embodiment 1

The current airport and port terminal pavements are paved with cement concrete because they can withstand heavy loads, such as airplanes and container trucks, and their load-bearing capacity is far superior to that of asphalt pavements. When cement concrete pavements are damaged and need to be repaired, the common approach is to use a sledgehammer to demolish the pavement, remove the debris completely, and then pour in new cement, which takes more than twenty days to reach the required strength to meet the needs of navigation and traffic. The maintenance is difficult and the cycle is long. Therefore, how to quickly replace the damaged pavement slabs with new ones to achieve quick navigation and traffic is the fundamental technical problem to be solved.

In the related art, the conventional technical scheme is to demolish by hammering the pavement, which is inefficient and requires more manpower and resources to collect the broken pieces after the hammering. This extends repair time for the damaged pavement and increases the subsequent repair time for the damaged pavement, thus reducing the efficiency of pavement repair.

As shown in FIGS. 1-8, in order to solve the above-mentioned technical problems, a device of demolishing of a cement concrete pavement slab is provided. The device of demolishing of the cement concrete pavement slab includes a demolishing vehicle 1. The demolishing vehicle 1 is provided with a power source, a driving module, and a controlling module. The driving module propels the demolishing vehicle 1, while the controlling module manages movement directions, movement trajectory, and operational parameters of the demolishing vehicle 1. The demolishing vehicle 1 includes a base 11, first boxes 2, second boxes 3, third boxes 4, driving crossbeams 14 and driving longitudinal beams 15.

The base is disposed at a bottom of the demolishing vehicle 1, a pavement range finder 12 is disposed at a bottom of the base 11. The pavement range finder 12 is a conventional device in this field for measuring the thickness of cement concrete pavement, such as a laser rangefinder. A shape of the base 11 is square, and the bottom of the base 11 is slidably provided with positioning transceivers 13 at four corners of the bottom of the base 11, respectively. In the disclosure, the positioning transceiver 13 is a conventional positioning component set in related art, including a positioning device and a transceiver, such as a wireless positioning transmitter and receiver. Before a construction, the positioning devices are disposed at four target points of the pavement demolishing area. The positioning devices send signals to the transceivers, which, upon receiving the signals, uses the controlling module in the demolishing vehicle 1 to direct the driving module to move towards the positioning devices. This movement continues until the demolishing vehicle 1 reaches the rectangular pavement demolishing area defined by the positioning transceivers 13, thus completing the automatic positioning of the working area of the demolishing vehicle 1 relative to the pavement demolishing area. During the construction, the positioning transceivers 13, based on the area of the pavement demolishing area defined by the positioning devices, use the controlling module to control the driving crossbeams 14 and the driving longitudinal beams 15 to drive the first boxes 2, the second boxes 3, and the third boxes 4 to move to planned edges of the rectangular pavement demolishing area, completing the calibration and positioning of the road cutting position.

The first boxes 2 defined with first openings at bottoms thereof are slidably installed at the bottom of the base 11, a first telescoping rod 21 is disposed in the each of the first boxes 2, a working end of the first telescoping rod 21 is provided with a first saw 22, and a top of each of the first boxes 2 is provided with a first moving component 23.

The second boxes 3 defined with second openings at bottoms thereof are slidably installed at the bottom of the base 11, a second telescoping rod 31 is disposed in each of the second boxes 3, a working end of the second telescoping rod 31 is provided with a second saw 32, and a top of each of the second boxes 3 is provided with a second moving component 33.

The third boxes 4 defined with third openings at bottoms thereof are slidably installed at installed at the base 11, a third telescoping rod 4 is disposed in each of the third boxes 4, a working end of the third telescoping rod 41 is provided with a third saw 42, and a top of each of the third boxes 4 is provided with a third moving component 43. The first box 2, the second box 3, and the third box 4 are arranged in a straight line in that order, and the first box 2, the second box 3, and the third box 4 are as a respective one of four groups disposed at the bottom of the base 11, and movement paths of the four groups of the first boxes 2, the second boxes 3, and the third boxes 4 form the rectangular pavement demolishing area. The first moving component 23, the second moving component 33, and the third moving component 43 are conventional components in this field for driving the movement of parts, such as motor-driven wheels. The first moving component 23, the second moving component 33, and the third moving component 43 respectively drive the corresponding first box 2, the corresponding second box 3, and the corresponding third box 4 to move along the same straight line in that order to complete the cutting work on the pavement.

The driving crossbeams 14 are disposed on the bottom of the base 11, and the driving longitudinal beams 15 are disposed between the driving crossbeams 14 and the base 11. The first boxes 2, the second boxes 3, and the third boxes 4 are all disposed at bottoms of the driving crossbeams 14 and the driving longitudinal beams 15, and the number of the driving crossbeams 14 and the number of the driving longitudinal beams 15 are two. A cooling component 16 is disposed at the bottom of the base 11, the cooling component is configured to cool the first saws 22, the second saws 32, and the third saws 42. The driving crossbeams 14 and the driving longitudinal beams 15 are conventional driving components. The driving crossbeams 14 and the driving longitudinal beams 15 drive each group of the first box 2, the second box 3, and the third box 4 to move together, adjusting the cutting range of the four groups of the first boxes 2, the second boxes 3, and the third boxes 4 to coincide with the range of the pavement demolishing area. The cooling component 16 is a conventional cooling component and is used for cooling the first saws 22, the second saws 32, and the third saws 42 during the cutting process.

A specific workflow of the device is as follows.

Before a construction, the positioning devices are disposed at four target points of the pavement demolishing area. The positioning devices send signals to the transceivers, which, upon receiving the signals, uses the controlling module in the demolishing vehicle 1 to direct the driving module to move towards the positioning devices. This movement continues until the demolishing vehicle 1 reaches the rectangular pavement demolishing area defined by the positioning devices, thus completing the automatic positioning of the working area of the demolishing vehicle 1 relative to the pavement demolishing area. During the construction, the positioning transceiver 13, based on the area of the pavement demolishing area defined by the positioning devices, uses the controlling module to control the driving crossbeams 14 and the driving longitudinal beams 15 to drive the first boxes 2, the second boxes 3, and the third boxes 4 to move to the planned edges of the rectangular pavement demolishing area, completing the calibration and positioning of the road cutting position.

During the cutting process, the two driving crossbeams 14 first drive the first saws 22, the second saws 32, and the third saws 42 on the two driving crossbeams 14 to move to the designated positions, after which the first saws 22, the second saws 32, and the third saws 42 on the two driving crossbeams 14 proceed with the cutting. Once the cutting by the first saws 22, the second saws 32, and the third saws 42 on the two driving crossbeams 14 is completed, the first saws 22, the second saws 32, and the third saws 42 on the two driving crossbeams 14 are respectively lifted by the first telescoping rods 21, the second telescoping rods 31, and the third telescoping rods 41 on the two driving crossbeams 14. The two driving longitudinal beams 15 then drive the first saws 22, the second saws 32, and the third saws 42 on the two driving longitudinal beams 15 over the first saws 22, the second saws 32, and the third saws 42 on the two driving crossbeams 14 to move to reach the designated positions, and then the first saws 22, the second saws 32, and the third saws 42 on the two driving longitudinal beams 15 proceed with the cutting until the cement layer of the pavement is completely cut. By coordinating the driving crossbeams 14 and the driving longitudinal beams 15, the rectangular pavement demolishing area can be cut along two edges simultaneously, which means that only two sets of cutting steps are needed to complete the cutting of the rectangular pavement demolishing area. This accelerates the cutting speed, improves the efficiency of pavement demolishing, and consequently enhances the efficiency of subsequent pavement repair.

In related art, when demolishing the pavement, a saw blade with a radius larger than the thickness of cement concrete layer of the road is used for cutting. However, the large saw blade generates significant vibration and shaking during high-load cutting of the cement. This results in slow pavement cutting and demolishing speeds, reducing the efficiency of the demolishing process and, consequently, the efficiency of pavement repair. Moreover, due to the large radius of the saw blade and its deep penetration into the cement layer, it is susceptible to operational errors or axial forces that can cause the saw blade to jam, or even lead to the saw blade breaking and flying out. This not only affects the efficiency of the pavement cutting and demolishing but also adds additional safety hazards to the construction process. In the disclosure, when cutting the pavement demolishing area, initially, the first telescoping rods 21 drive the first saws 22 to make contact with the pavement. The first moving components 23 then drive the first boxes 2 and the first saws 22 to make a first cutting on the pavement in a straight line direction, creating a shallow groove on the pavement. After the first saws 22 has cut the pavement to the specified length, the second telescoping rods 31 drive the second saws 32 to make contact with the pavement. The second moving components 33 then drive the second boxes 3 and the second saws 32 to make a second cutting along the cutting path of the first saws 22, creating a deeper groove on the pavement. Finally, after the second saws 32 has cut the pavement to the specified length, the third telescoping rods 41 drive the third saws 42 to make contact with the pavement. The third moving component 43 then drive the third boxes 4 and the third saws 42 to make a third cutting along the cutting path of the second saws 32. The cooling component 16 cools the first saws 22, the second saws 32, and the third saws 42, ultimately completing the cutting work of the cement concrete layer on the pavement.

By sequentially cutting the pavement with the first saws 22, the second saws 32, and the third saws 42, the disclosure, as compared to the related art that uses a single saw blade to cut the pavement in one go, employs a method of cutting multiple times from shallow to deep. This disclosure can effectively avoid the safety hazards associated with the operation of a single saw blade, thereby enhancing the safety of construction. Moreover, the first shallow cutting allows the first saws 22 to make a minimal cut into the cement layer, which increases the cutting speed. The second deeper cutting is made on the basis of the groove cut by the first saws 22, and although the second saws 32 have a larger feed, the cutting thickness of the cement layer is reduced by the first saws 22, resulting in a reduced cutting volume for the second saws 32 while also increasing the cutting speed. The third cutting follows the same principle as the previous cuttings, allowing for multiple cuttings while still improving the cutting speed. This increases the efficiency of road demolishing construction, accelerates the replacement of pavement slabs, and thus improves the efficiency of road repair, achieving the effect of quick navigation and traffic.

Subsequently, construction personnel replace and repair the cut slabs by changing the equipment.

Embodiment 2

Based on the embodiment 1, as shown in FIGS. 3-7, the first saw 22 and the second saw 32 are circular saws, and a size of the first saw 22 is smaller than that of the second saw 32. The third saw 42 is a chain saw.

The first saw 22 and the second saw 32 include multiple saw blades, and the multiple saw blades in the first saw 22 and the second saw 32 are uniformly disposed side by side. Cutting widths of the first saw 22, the second saw 32, and the third saw 42 are the same.

Widths between sides facing away from each other of adjacent first saws 22, between sides facing away from each other of adjacent second saws 32, and between sides facing away from each other of adjacent third saws 42 are the same as a width of the rectangular pavement demolishing area.

A specific workflow of the device is as follows.

By providing the first saws 22 and the second saws 32 as the circular saws, and sizes of the first saws 22 are smaller than that of the second saws 32, the disclosure allows for a shallower cutting with the first saws 22. The sizes of the first saws 22 is reduced to help to decrease the vibration it generates during rapid cutting, which in turn increases the cutting speed of the first saws 22 and enhances the cutting speed for pavement demolishing. Additionally, during the installation process, cameras can be added to the bottom of the base 11 to observe and confirm whether the grooves formed by the cutting process of the first saws 22 comply with the specified cutting path. This facilitates timely adjustments to avoid significant errors in cutting that could affect construction, thereby improving the practicality of the disclosure.

When using standard circular saws to cut a rectangular pavement demolishing area on the pavement, if the goal is to completely cut through the cement layer of the pavement, the standard circular saws must pass through round the rectangular pavement demolishing area. This results in the four cutting grooves forming a cross pattern after the cutting is completed, with the central rectangular part being the area to be removed. The additional cutting grooves formed outside the pavement demolishing area require construction personnel to select materials for repair. These extra cutting grooves, due to their narrow width, are difficult to repair and can cause potential repair risks, reducing the service life after repair. Therefore, the pavement demolishing effect directly affects the quality and efficiency of subsequent road repairs. Therefore, the disclosure selects chain saws as the third saws 42, which is a specialized cutting tool for the cement concrete in this field. This allows the cutting surfaces before and after the third saws 42 move to the specified position to be vertical faces. When the third saws 42 are lifted after cutting, the side walls formed within the pavement cutting grooves are vertical planes. This avoids creating excessive cutting grooves on the pavement, improves the cutting effect of the third saws 42, and thus enhances the pavement demolishing effect. It reduces subsequent road repair construction operations and facilitates subsequent road repairs.

Because the first saw 22 and the second saw 32 include the multiple saw blades, and the multiple saw blades in the first saw 22 and the second saw 32 are uniformly disposed side by side, which make the cutting widths of the first saw 22, the second saw 32, and the third saw 42 are the same. Since the thicknesses of the chain saws are greater than the thickness of the circular saws, the cutting groove width of the third saw 42 is greater than that of the first saw 22 and the second saw 32. However, the multiple cutting grooves formed by the multiple saw blades of the first saw 22 and the second saw 32 have a width that is the same as the cutting groove width of the third saws 42. After the second saw 32 cuts to form the multiple grooves, it reduces the cutting volume during the cutting process of the third saw 42, which increases the cutting speed of the third saw 42. This, in turn, improves the efficiency of pavement demolishing and thereby enhances the efficiency of road demolishing.

In the embodiment, by setting that the widths between sides facing away from each other of adjacent first saws 22, between sides facing away from each other of adjacent second saws 32, and between sides facing away from each other of adjacent third saws 42 are the same as a width of the rectangular pavement demolishing area. The disclosure allows the cutting grooves to widen while reducing the spacing between the first saws 22, the second saws 32, and the third saws 42. This ensures that the size of the pavement demolishing area remains unchanged, shortens the spacing between the first saws 22, the second saws 32, and the third saws 42, and achieves the goal of extending the cutting grooves into the pavement demolishing area to widen them. This design avoids the cutting grooves affecting areas outside the pavement demolishing area, which could cause errors in the pavement demolishing area.

Embodiment 3

Based on the embodiment 2, as shown in FIGS. 2-8, in each one of the four groups, the second box 3 is provided with a telescopic rod 34 on a side facing away from the first box 2, the telescopic rod 34 is a conventional telescopic component used to drive a first plate 35 for lifting. A working end of the telescopic rod 34 is provided with a first plate 35, the telescopic rod 34 is a conventional electric telescopic component. First blocks 36 are symmetrically slidingly connected to a bottom of the first plate 35, a limit plate 37 is disposed at tops of the first blocks 36, and the limit plate 37 penetrates through the first plate 35 and is located at a top of the first plate 35. The top of the first plate 35 is slidably connected to a limit rod 38, and a spring is provided between the limit rod 38 and the first plate 35. A side of the first plate 35 facing the limit rod 38 is a serrated part, and a middle part of the limit rod 38 is engaged with the serrated part of the first plate 35. A reset board 5 is disposed at a side of the second box 3, and the reset board 5 is inclinedly disposed above the limit board 37.

A cross-section of each first block 36 is a triangle, and sides of first blocks 36 close to each other are a vertical plane. A side of the second box 3 close to the telescopic rod 34 is slidably and inclinedly connected to a guide plate 6, and a spring is disposed between the first plate 35 and the guide plate 6. A collection box 61 is disposed on another side of each second box 3, and a top opening of the collection box 61 is close to an end of the guide plate 6.

The sides of the first blocks 36 close to each other are serrated parts, and the serrated parts in the first block 36 are inclined towards the first plate 35.

A specific workflow of the device is as follows.

In each group, during the cutting process of the second saw 32, the telescopic rod 34 disposed between the second saw 32 and the first plate 35 is periodically operated under the control of the controlling module in the demolishing vehicle 1. At specified intervals, the telescopic rod 34 drives the first plate 35 to descend, which in turn causes the first blocks 36 to lower. The ends of the first blocks 36 facing away from the first plate 35 enters the cutting grooves. At this point, the multiple cutting grooves formed by the second saw 32 are gradually squeezed by the first blocks 36, causing the multiple cutting grooves to fracture into thin slabs. Since the cross-section of each first block 36 is triangular, the inclined surface of the first plate 35 makes contact with the cutting grooves and guides the first blocks 36. This action allows the first blocks 36 to approach each other as they extend into the cutting grooves, clamping the fractured fragments in the cutting grooves. The setting of the first blocks 36 drives the movement of the limit plate 37, whose serrated edge on a side continuously presses against and passes over the limit rod 38. This continues until the adjacent first blocks 36 clamp the fragments within the cutting grooves. At this moment, the limit rod 38 locks into the serrated part of the limit plate 37, and immobilizing the limit plate 37. The telescopic rod 34 drives the first blocks 36 to ascend through the first board 35, lifting the clamped fragments from the cutting grooves and cleaning the interior of the cutting grooves. This reduces the residual amount of cement in the cutting grooves after performing the second cutting of the second saws 32, thereby decreasing the residual amount of cement in the cutting grooves during the cutting process of the third saws 42. This reduction in cutting volume for the third saws 42 increases its cutting speed and, consequently, improves the efficiency of the pavement demolishing.

During the descent of the first blocks 36, the first blocks contact the surface of the guide plate 6. As the end of each first block 36 presses against the inclined surface of the guide plate 6, the guide plate 6 moves away from the collection box 61, allowing the first blocks 36 to pass through the space between the guide plate 6 and the collection box 61 to clamp the fragments in the cutting grooves. After the first blocks 36 clamp the fragments, and the first blocks 36 begins to ascend, they carries the fragments closer to the second box 3. At this point, the first blocks 36 no longer exert pressure on the guide plate 6, which then resets to a position where the end of each first block 36 extends into the opening of the collection box 61, and facilitated by a spring. As the first plate 35 lifts the first blocks 36, the limit plate 37 and the limit rod 38, the limit rod 38 contacts the reset board 5. The inclined surface of the reset board 5 guides the limit rod 38, causing it to move away from the serrated part of the limit plate 37. Once the limit rod 38 no longer locks the limit plate 37, the spring between adjacent first blocks 36 drive the first blocks 36 and the limit plate 37 to move apart and reset. The fragments clamped by the first blocks 36 then drops onto the surface of the guide plate 6 and slides into the collection box 61, thereby completing the collection of pavement cement fragments. This reduces the labor intensity for construction personnel and enhances the practicality of the disclosure.

In addition, by setting that the sides of the first blocks 36 close to each other are the serrated parts, and the serrated parts in the first blocks 36 are inclined towards the first plate 35, the disclosure ensures that as the first blocks 36 extend into the cutting grooves to clamp the fragments, the serrated parts of the first blocks 36 bite into the fragments, which enhances the stability with which the first blocks 36 hold the cement fragments within the cutting grooves, facilitating the collection of pavement cement fragments.

Embodiment 4

Based on the embodiment 3, as shown in FIGS. 1-7, the first saw 22, the second saw 32, and the third saw 42 are provided with a dust cover 17.

Sweeping brushes 18 are arranged around the demolishing vehicle 1 in a sliding connection manner, and the demolishing vehicle 1 is provided with limited position pins 19 disposed below the sweeping brushes 18.

A specific workflow of the device is as follows.

By providing the first saw 22, the second saw 32, and the third saw 42 with a dust covers 17, the disclosure reduces the splashing and dispersion of dust and cooling water during the cutting process, thereby improving the working environment for construction personnel. Additionally, before the demolishing vehicle 1 moves towards the pavement demolishing area, the construction personnel remove the limited position pins 19, and the sweeping brushes 18 slides down the side of the demolishing vehicle 1 to contact the pavement due to gravity. This action sweeps away fragments in the pavement demolishing area as the demolishing vehicle 1 moves, preventing the fragments on the pavement from affecting the operation of the pavement range finder 12, thus enhancing the practicality of the disclosure. After the demolishing is completed, the sweeping brushes 18 are moved upward to reset, and the limited position pins 19 are reinserted to support and limit the position of the sweeping brushes 18. Furthermore, when installing the sweeping brushes 18, a lifting mechanism can be added and connected to the sweeping brushes 18 to achieve the function of automatically raising and lowering the sweeping brushes 18.

Embodiment 5

Figure 9:
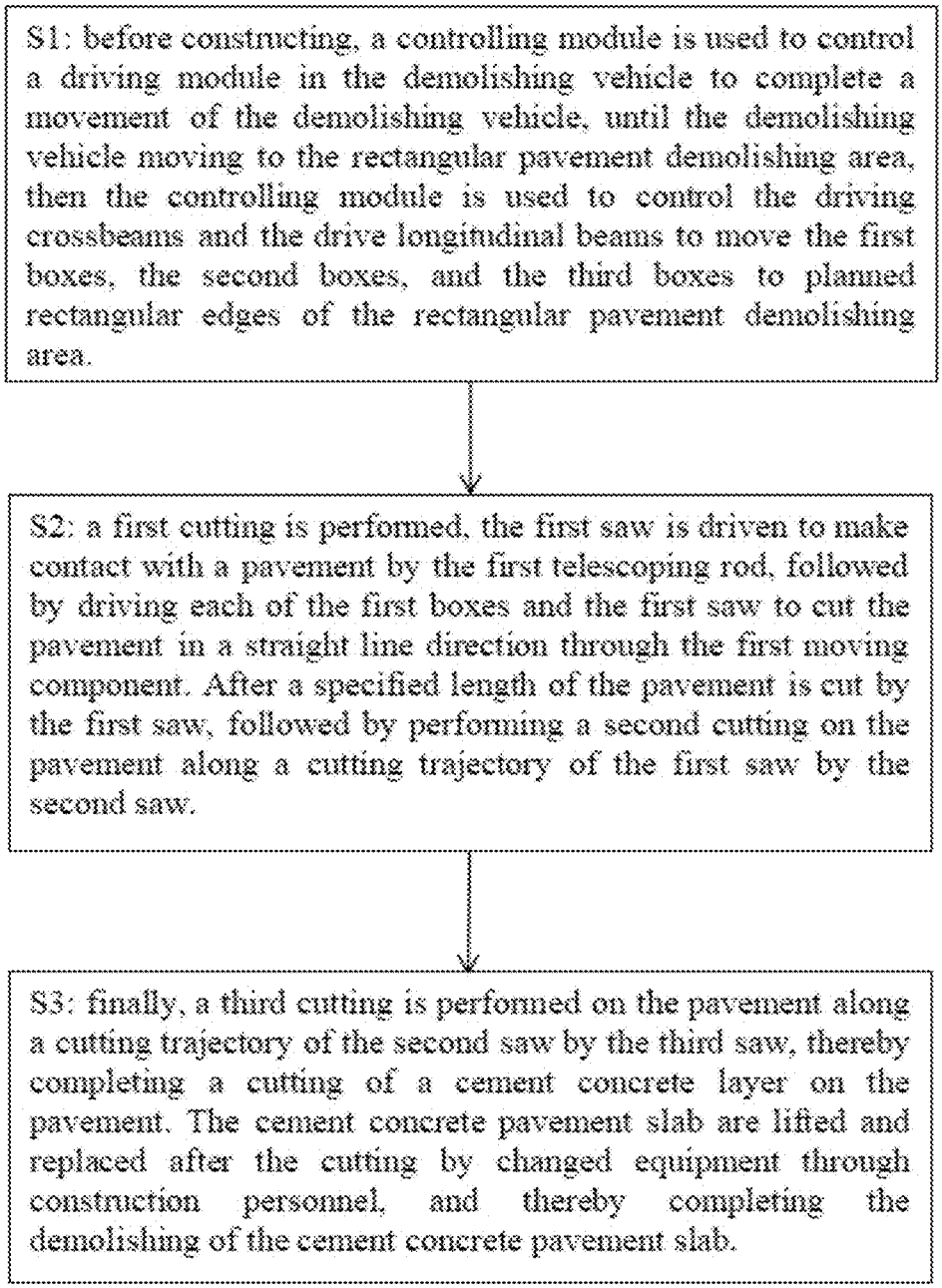
FIG. 9 illustrates a flowchart of a method for rapid demolishing of the cement concrete pavement slab in the disclosure.

As shown in FIG. 9, a method for rapid demolishing of the cement concrete pavement slab is provided and includes steps as follows.

S1: before constructing, a controlling module is used to control a driving module in the demolishing vehicle 1 to complete a movement of the demolishing vehicle 1, until the demolishing vehicle 1 moving to the rectangular pavement demolishing area, then the controlling module is used to control the driving crossbeams 14 and the drive longitudinal beams 15 to move the first boxes 2, the second boxes 3, and the third boxes 4 to planned rectangular edges of the rectangular pavement demolishing area.

S2: a first cutting is performed, the first saw 22 is driven to make contact with a pavement by the first telescoping rod 21, followed by driving each of the first boxes 2 and the first saw 22 to cut the pavement in a straight line direction through the first moving component 23. After a specified length of the pavement is cut by the first saw 22, followed by performing a second cutting on the pavement along a cutting trajectory of the first saw 22 by the second saw 32.

S3: finally, a third cutting is performed on the pavement along a cutting trajectory of the second saw 32 by the third saw 42, thereby completing a cutting of a cement concrete layer on the pavement. The cement concrete pavement slab are lifted and replaced after the cutting by changed equipment through construction personnel, and thereby completing the demolishing of the cement concrete pavement slab.

The above shows and describes the basic principles, main features, and advantages of the disclosure. Those skilled in the art should understand that the disclosure is not limited by the above embodiments. The descriptions in the above embodiments and instructions only illustrate the principles of the disclosure. Without departing from the spirit and scope of the disclosure, there may be various changes and improvements to the disclosure, all of which fall within the scope of the claimed protection. The scope of protection claimed by the disclosure is defined by the accompanying claims and their equivalents.

What is claimed is:

1. A device of demolishing of a cement concrete pavement slab, comprising a demolishing vehicle (1);

wherein the demolishing vehicle (1) comprises:

a base (11), wherein the base is disposed at a bottom of the demolishing vehicle (1), a pavement range finder (12) is disposed at a bottom of the base (11), a shape of the base (11) is square, and positioning transceivers (13) are slidably installed at four corners of the bottom of the base (11), respectively;

first boxes (2), wherein the first boxes (2) defined with first openings at bottoms thereof are slidably installed at the bottom of the base (11), each of the first boxes (2) is disposed with a first telescoping rod (21), a working end of the first telescoping rod (21) is provided with a first saw (22), and a top of each of the first boxes (2) is provided with a first moving component (23);

second boxes (3), wherein the second boxes (3) defined with second openings at bottoms thereof are slidably installed on the bottom of the base (11), each of the second boxes (3) is disposed with a second telescoping rod (31), a working end of the second telescoping rod (31) is provided with a second saw (32), and a top of each of the second boxes (3) is provided with a second moving component (33);

third boxes (4), wherein the third boxes (4) defined with third openings at bottoms thereof are slidably installed on the bottom of the base (11), each of the third boxes (4) is disposed with a third telescoping rod (41), a working end of the third telescoping rod (41) is provided with a third saw (42), and a top of each of the third boxes (4) is provided with a third moving component (43); the first box (2), the second box (3), and the third box (4) are arranged in a straight line in that order, and the first box (2), the second box (3), and the third box (4) are as a respective one of four groups disposed at the bottom of the base (11), and movement paths of the four groups of the first boxes (2), the second boxes (3), and the third boxes (4) form a rectangular pavement demolishing area; and driving crossbeams (14), wherein the driving crossbeams (14) are disposed on the bottom of the base (11), and driving longitudinal beams (15) are disposed between the driving crossbeams (14) and the base (11); the first boxes (2), the second boxes (3), and the third boxes (4) are all disposed at bottoms of the driving crossbeams (14) and the driving longitudinal beams (15), and a number of the driving crossbeams (14) and a number of the driving longitudinal beams (15) are two; a cooling component (16) is disposed at the bottom of the base (11), the cooling component is configured to cool the first saw (22), the second saw (32), and the third saw (42);

wherein the second box (3) is provided with a telescopic rod (34) on a side facing away from the first box (2), and a working end of the telescopic rod (34) is provided with a first plate (35); first blocks (36) are symmetrically slidingly connected to a bottom of the first plate (35), a limit plate (37) is disposed at tops of the first blocks (36), and the limit plate (37) penetrates through the first plate (35) and is located at a top of the first plate (35); the top of the first plate (35) is slidably connected to a limit rod (38), and a spring is provided between the limit rod (38) and the first plate (35); a side of the first plate (35) facing the limit rod (38) is a serrated part, and a middle part of the limit rod (38) is engaged with the serrated part of the first plate (35); a reset board (5) is disposed at a side of the second box (3), and the reset board (5) is inclinedly disposed above the limit plate (37);

wherein a cross-section of each of the first blocks (36) is a triangle, and sides of the first blocks (36) close to each other are vertical planes; a side of the second box (3) close to the telescopic rod (34) is slidably and inclinedly connected to a guide plate (6), and a spring is disposed between the first plate (35) and the guide plate (6); a collection box (61) is disposed on another side of the second box (3), and a top opening of the collection box (61) is close to an end of the guide plate (6); and wherein the sides of the first blocks (36) close to each other are serrated parts, and the serrated parts in the first blocks (36) are inclined towards the first plate (35).

2. The device of demolishing of the cement concrete pavement slab as claimed in claim 1, wherein the first saw (22) and the second saw (32) are circular saws, and a size of the first saw (22) is smaller than that of the second saw (32); and the third saw (42) is a chain saw.

3. The device of demolishing of the cement concrete pavement slab as claimed in claim 2, wherein the first saw (22) and the second saw (32) comprise a plurality of saw blades, and the plurality of saw blades in the first saw (22) and the second saw (32) are uniformly disposed side by side; and cutting widths of the first saw (22), the second saw (32), and the third saw (42) are the same.

4. The device of demolishing of the cement concrete pavement slab as claimed in claim 3, wherein widths between sides facing away from each other of adjacent first saws (22), between sides facing away from each other of adjacent second saws (32), and between sides facing away from each other of adjacent third saws (42) are the same as a width of the rectangular pavement demolishing area.

5. The device of demolishing of the cement concrete pavement slab as claimed in claim 1, wherein the first saw (22), the second saw (32), and the third saw (42) each are provided with a dust cover (17).

6. The device of demolishing of the cement concrete pavement slab as claimed in claim 1, wherein sweeping brushes (18) are arranged around the demolishing vehicle (1) in a sliding connection manner, and the demolishing vehicle (1) is provided with limited position pins (19) disposed below the sweeping brushes (18).

7. A method for demolishing of the cement concrete pavement slab, using the device of demolishing of the cement concrete pavement slab as claimed in claim 1, comprising:

S1: before constructing, using a controlling module to control a driving module in the demolishing vehicle (1) to complete a movement of the demolishing vehicle (1), until the demolishing vehicle (1) moving to the rectangular pavement demolishing area, then using the controlling module to control the driving crossbeams (14) and the driving longitudinal beams (15) to move the first boxes (2), the second boxes (3), and the third boxes (4) to planned rectangular edges of the rectangular pavement demolishing area;

S2: performing a first cutting, driving the first saw (22) to make contact with a pavement by the first telescoping rod (21), followed by driving each of the first boxes (2) and the first saw (22) to cut the pavement in a straight line direction through the first moving component (23); after cutting a specified length of the pavement by the first saw (22), followed by performing a second cutting on the pavement along a cutting trajectory of the first saw (22) by the second saw (32); and S3: finally, performing a third cutting on the pavement along a cutting trajectory of the second saw (32) by the third saw (42), thereby completing a cutting of a cement concrete layer on the pavement; lifting and replacing the cement concrete pavement slab after the cutting by changed equipment through construction personnel, and thereby completing the demolishing of the cement concrete pavement slab.

* * * * *